US007074254B2

(12) United States Patent
Fujisawa et al.

(10) Patent No.: US 7,074,254 B2
(45) Date of Patent: Jul. 11, 2006

(54) BINDER FOR POWDER METALLURGY, MIXED POWDER FOR POWDER METALLURGY AND METHOD FOR PRODUCING SAME

(75) Inventors: Kazuhisa Fujisawa, Kobe (JP); Hironori Suzuki, Takasago (JP)

(73) Assignee: Kobe Steel Ltd., Kobe (JP)

( * ) Notice: Subject to any disclaimer, the term of this patent is extended or adjusted under 35 U.S.C. 154(b) by 4 days.

(21) Appl. No.: 10/782,850

(22) Filed: Feb. 23, 2004

(65) Prior Publication Data

US 2004/0168547 A1 Sep. 2, 2004

(30) Foreign Application Priority Data

Feb. 27, 2003 (JP) ..... 2003-051692

(51) Int. Cl.
*B22F 1/00* (2006.01)

(52) U.S. Cl. ..... 75/252; 419/65

(58) Field of Classification Search ..... 75/252; 419/65; 528/86

See application file for complete search history.

(56) References Cited

U.S. PATENT DOCUMENTS

| | | | | |
|---|---|---|---|---|
| 3,412,043 | A * | 11/1968 | Gilliland | 252/514 |
| 4,554,218 | A * | 11/1985 | Gardner et al. | 428/567 |
| 6,048,379 | A * | 4/2000 | Bray et al. | 75/229 |
| 6,124,381 | A * | 9/2000 | Miyake et al. | 523/461 |
| 6,190,578 | B1 * | 2/2001 | Yokoyama et al. | 252/512 |

FOREIGN PATENT DOCUMENTS

| | | |
|---|---|---|
| JP | 4-236402 | 8/1992 |
| WO | WO 96/30144 | 10/1996 |

* cited by examiner

*Primary Examiner*—Ngoclan T. Mai
(74) *Attorney, Agent, or Firm*—Oblon, Spivak, McClelland, Maier & Neustadt, P.C.

(57) ABSTRACT

The invention aims to provide a binder for powder metallurgy, the binder containing an epoxy resin which is liquid at room temperature and a curing agent having at least one functional group selected from the group consisting of amino, mercapto and carboxyl groups. The binder involves few problems in point of workability and safety, suppress the scattering of graphite, and is superior in powder characteristics. The invention also provides a mixed powder for powder metallurgy using the binder and a method for producing the mixed powder.

5 Claims, 2 Drawing Sheets

BINDER FOR POWDER METALLURGY, MIXED POWDER FOR POWDER METALLURGY AND METHOD FOR PRODUCING SAME

BACKGROUND OF THE INVENTION

1. Field of the Invention

The present invention relates to a binder for powder metallurgy capable of being suitably incorporated in a raw powder for powder metallurgy, such as iron powder or copper powder, also relates to a mixed powder for powder metallurgy, and further relates to a method for producing the mixed powder for powder metallurgy.

2. Description of the Prior Art

A mixed powder for powder metallurgy is generally produced by mixing an iron powder-based metal powder with an alloying powder such as graphite, nickel, copper, or molybdenum, and then treating the resulting powder mixture with a binder. The binder treatment permits prevention of segregation of components caused by the difference in specific gravity between the metal powder and the alloying powder such as graphite, and suppression of scattering of graphite, etc.

As one example, Japanese Patent No. 1597077 discloses a binder treatment method comprising the steps of mixing a solution type binder with a raw powder, which binder comprises a vinyl acetate homopolymer or a polyester resin dissolved in a solvent, and then removing the solvent by volatilization. As another example, JP-B No. 89364/1994 discloses a binder treatment method comprising melt-mixing zinc stearate or a wax with a raw powder for subsequent cooling.

Treating a raw powder for powder metallurgy with a binder and allowing the binder to fulfill its function to a satisfactory extent needs to first mix binder components and a raw powder intimately. From this standpoint, a solution type binder of a low viscosity is used as the binder. In this case, for minimizing the influence of the solvent used in the solution type binder on physical properties of the final powder metallurgy product, the solvent is removed by volatilization from the mixed powder. From the standpoint of easiness of solvent removal by volatilization and solubility of the base resin in the binder, such a solvent as toluene or acetone is used as the solvent for the binder. However, these solvents are highly flammable and such a danger as fire is involved in the manufacturing process for a mixed powder for powder metallurgy. Moreover, in view of the recent demand for coping with environmental problems, it is required to decrease the amount of the solvent used.

Poor performance of the binder for powder metallurgy used might not only bring about the foregoing segregation of components or scattering of graphite results, but also badly influence characteristics of the resulting mixed powder. Further, for example, the binder needs to possess heat resistance at a warm molding temperature in the range from room temperature to 200° C. or so, and at the same time needs, in sintering, to decompose thermally with ease and afford a good molded product of powder metallurgy without any residue.

SUMMARY OF THE INVENTION

Under the circumstances, the present invention aims to provide a binder for powder metallurgy involving few problems in point of safety, capable of suppressing the scattering of graphite and superior in powder characteristics, a mixed powder for powder metallurgy using this binder, and a method for producing the mixed powder.

According to a first aspect of the invention, the binder for powder metallurgy is to be incorporated in a raw powder for powder metallurgy and is characterized by containing an epoxy resin which is liquid at room temperature and a curing agent which has at least one functional group selected from the group consisting of amino, mercapto and carboxyl groups. The binder that uses an epoxy resin which is liquid at room temperature permits the binder and a raw powder for powder metallurgy intimately to be mixed without the need of using a flammable solvent for example.

According to a second aspect of the invention, in the binder of the first aspect, it is preferable for the epoxy resin to have a viscosity of 15,000 mPa·s or less at 25° C. This is because setting the viscosity at 15,000 mPa·s or less enables dispersibility of the binder in the raw powder to be enhanced.

According to a third aspect of the invention, in the binder of the first aspect, a bisphenol A type epoxy resin or a bisphenol F type epoxy resin is employable suitably as the epoxy resin.

According to a fourth aspect of the invention, in the binder of the first aspect, a curing agent having an amino group is employable suitably as the curing agent.

According to a fifth aspect of the invention, the mixed powder for powder metallurgy contains a raw powder for powder metallurgy and a cured product of the binder of the first aspect.

According to a sixth aspect of the invention, it is preferable that the content of the cured binder be 0.01 to 0.5 parts by weight based on 100 parts by weight of the raw powder.

According to a seventh aspect of the invention, the method for producing the mixed powder for powder metallurgy is characterized by the steps of adding the binder of the first aspect for powder metallurgy to a raw powder for powder metallurgy, mixing the two, and allowing the binder to cure.

In the invention, a mixed powder of a metal powder and another alloy powder, which has not been treated with a binder or a lubricant, is designated "raw powder for powder metallurgy (simply "raw powder" as the case may be)," while a mixed powder of a metal powder and another alloy powder, which has been treated with a binder or a lubricant, is designated "mixed powder for powder metallurgy (simply "mixed powder" as the case may be)."

This invention, which does not use a highly flammable solvent having an offensive smell, has few problems in point of safety and workability. Besides, the invention may provide a mixed powder for powder metallurgy capable of preventing the scattering of graphite, etc. effectively and superior in powder characteristics, especially powder characteristics in a warm condition.

DETAILED DESCRIPTION OF THE PREFERRED EMBODIMENTS

Figure 1:
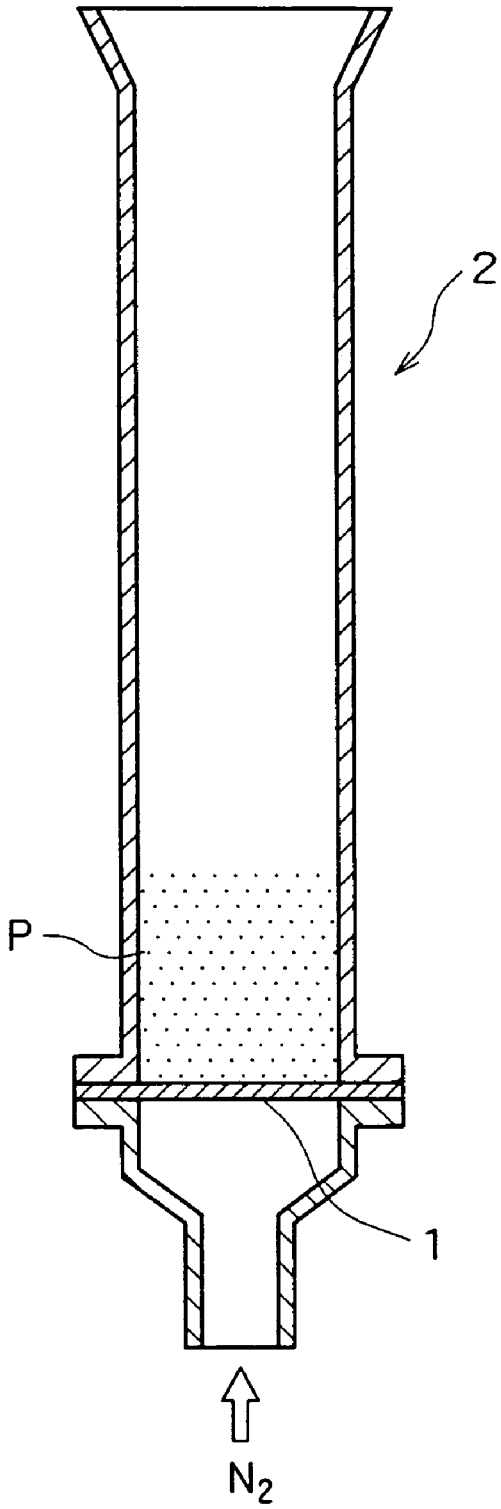
FIG. 1 is a schematic sectional view of a measuring device for measuring a percent graphite scattering.

The binder for powder metallurgy according to the invention is to be incorporated in a raw powder for power metallurgy and is characterized by containing an epoxy resin which is liquid at room temperature and a curing agent which has at least one functional group selected from the group consisting of amino, mercapto and carboxyl groups.

Reference will first be made to the epoxy resin which is liquid at room temperature. The epoxy resin which is liquid at room temperature indicates, for example, an epoxy resin which is liquid in the temperature range of 10° to 30° C. It is preferable that the viscosity of the epoxy resin which is liquid at room temperature be 15,000 mPa·s or less. There is a tendency that if the viscosity at 25° C. exceeds 15,000 mPa·s, it becomes difficult for the epoxy resin to be mixed intimately with the raw powder. The viscosity of the epoxy resin can be determined, for example, by detecting torque with use of a torque sensor which torque is generated when a rotor is rotated at a constant speed (20 rpm) within a sample and then measuring viscosity with use of a type B viscometer.

The epoxy resin which is liquid at room temperature is not specially limited insofar as the epoxy resin used is liquid at room temperature and contains at least two epoxy (glycidyl groups). As examples, mention may be made of such bisphenol type epoxy resins as bisphenol A, F, and AD type epoxy resins. A bisphenol type epoxy resin can be prepared, for example, by reacting bisphenol such as bisphenol A, bisphenol F, or bisphenol AD with epichlorohydrin and is thus available easily. It is also superior in binder performance for powder metallurgy. As a bisphenol type epoxy resin, one having a weight per epoxy equivalent of 150 to 300 g/eq, preferably 200 to 300 g/eq, is employable suitably.

Although the bisphenol type epoxy resin is liquid at room temperature, it does not correspond to the dangerous object defined by the Fire Service Law, involving no such problems in safety and working as the occurrence of fire and offensive smell. From such a standpoint, it is more preferable that the foregoing bisphenol type epoxy resin alone be used as the epoxy resin which is liquid at room temperature in the invention. But it is also preferable that such an epoxy compound as will be described below be used where required as a reactive diluent together with the bisphenol type epoxy resin to lower the viscosity of the bisphenol type epoxy resin. The reactive diluent, when added to the bisphenol type epoxy resin which is liquid at room temperature, not only lowers the viscosity of the epoxy resin, but also, at the time of curing with the curing agent, is cured together with the epoxy resin. The reactive diluent is superior in that it is not required to be removed by volatilization unlike such commonly-used solvents as toluene and acetone, and is also superior in point low flammability. It is employable in the invention.

As examples of epoxy compounds employable as reactive diluents there are mentioned polyethylene glycol, polypropylene glycol, neopentyl glycol, and 1,6-hexanediol, with epoxy group introduced into one or both ends thereof; glycidyl ether of trimethylolpropane; polyglycerol polyglycidyl ether; and sorbitol polyglycidyl ether.

As to the blending ratio between the reactive diluent and the bisphenol type epoxy resin which is liquid at room temperature, an appropriate ratio may be set according to the type of the epoxy resin used. For example, it is preferable that the two be added so as to adjust the viscosity of the bisphenol type epoxy resin to 5,000 mPas. or less, more preferably 1,000 mPas. or less.

In the invention, the curing agent having at least one functional group selected from the group consisting of amino, mercapto and carboxyl groups is preferably liquid at room temperature like the epoxy resin. This is not only for improving the dispersibility for the raw powder but also for making the curing reaction with the epoxy resin uniform.

As examples of the amino-containing curing agent there are mentioned aliphatic polyamides such as diethylenetriamine, dipropylenetriamine, triethylenetetramine, tetraethylenepentamine, dimethylaminopropylamine, diethylaminopropylamine, dibutylaminopropylamine, hexamethylenediamine, N-aminoethylpiperazine, bisaminopropylpiperazine, and trimethylhexamethylenediamine; alicyclic polyamines such as 3,3'-dimethyl-4,4'-diaminodicyclohexylmethane, 3-aminocyclohexylaminopropane, 4,4'-diaminodicyclohexylmethane, isophoronediamine, 1,3-bis (aminomethyl)cyclohexane, and N-dimethylcylocohexylamine; heterocyclic diamines such as 3,9-dipropaneamine-2,4,8,10-tetraoxospiro[5,5]undecane and modified compounds thereof; aromatic polyamines such as xylylenediamine; liquid polyamide resins; and modified polyamides as reaction products of dibasic dimer acids and polyamines such as diethylenetriamine. As the amino-containing curing agent there may be used a ketimine compound which is a condensation product of a primary amine and a ketone. The ketimine compound regenerates the primary amine in the presence of water and can act as a curing agent.

As examples of the merapto-containing curing agent there are mentioned mercaptoethanol and mercaptoacetic acid.

As the carboxyl-containing curing agent it is preferable to use an acid anhydride of a carboxyl-containing compound such as methyltetrahydrophthalic anhydride, methylendomethylene tetrahydrophthalic anhydride, methylhexahydrophthalic anhydride, or tetramethylenemaleic anhydride.

In the invention, the epoxy resin which is liquid at room temperature reacts with the amino-, mercapto-, or carboxyl-containing curing agent in the following manner and is cured. Epoxy rings present at ends of the epoxy resin react with the curing agent used and open, whereby the molecules of the epoxy resin are linked to one another. Since reactive groups are present at both ends of the curing agent, they bridge the epoxy resin.

Among the curing agents referred to herein, the amino-containing curing agent is preferred. Preferred examples of the amino-containing curing agent are heterocyclic diamines such as 3,9-dipropaneamine-2,4,8,10-tetraoxospiro [5,5]undecane and modified compounds thereof. This is because the amino group is highly reactive with epoxy groups contained in the epoxy resin and the curing reaction with the epoxy resin which is liquid at room temperature becomes easier.

The blending ratio of the epoxy resin and the curing agent is not specially limited, but, for example, it is preferably in the range of 1:0.9 to 1:1.1, more preferably 1:1, in terms of a mole ratio of epoxy groups in the epoxy resin to functional groups in the curing agent used. If the proportion of either the epoxy resin or the curing agent is too large, the curing will be insufficient and there will not be obtained a satisfactory binder performance.

The binder for powder metallurgy according to the invention may contain a lubricant if necessary in addition to the epoxy resin and the curing agent. The lubricant is not specially limited, examples of which include metal soaps, lithium stearate, fatty acid amides, hydrocarbon waxes, and crosslinked (meth)acrylic acid alkyl ester resins.

The mixed powder for powder metallurgy according to the invention contains a raw powder for powder metallurgy and the cured product of the binder described above. The raw powder for powder metallurgy is not specially limited insofar as it contains a metal powder containing iron as a main component and, if necessary, further contains another alloying powder. As examples of the metal powder containing iron as a main component there are mentioned a pure iron powder such as atomized iron powder or reduced iron powder, and a partially or completely alloyed powder alloyed beforehand with another element.

Also as to another alloying powder which is mixed, if necessary, with the metal powder containing iron as a main component, a suitable one may be selected according to desired physical properties. As examples there are mentioned powders of such alloying elements as copper, nickel, chromium, and molybdenum, and such inorganic components as graphite and manganese sulfide. It is preferable that the alloying elements in question be used in an amount of 5 parts by weight or less, more preferably 3 parts by weight or less, based on 100 parts by weight of the metal powder containing iron as a main component. If the amount of the alloying powder exceeds 5 parts by weight, there may occur a bad influence such as a lowering in strength of the resulting molded product. On the other hand, from the standpoint of obtaining desired physical properties, it is preferable that the amount of the alloying powder in question be 0.2 part by weight or more.

The cured product of the binder is not specially limited if only it is obtained by curing the binder described above. For example, when the binder and the raw powder are mixed together and cured, the cured product of the binder is present on surfaces of the metal powder containing iron as a main component and the alloying powder (graphite) and fix the two to prevent segregation of components and scattering of graphite.

The content of the cured product of the binder is not specially limited, but is preferably 0.01 part by weight or more, more preferably 0.03 to 0.5 part by weight, still more preferably 0.2 part by weight or less, based on 100 parts by weight of the raw powder for powder metallurgy. If the content of the binder cured product is less than 0.01 part by weight, there will not be obtained a satisfactory binder performance, with the result that segregation of alloy components and scattering of graphite are apt to occur. If the content in question exceeds 0.5 part by weight, powder characteristics of the resulting mixed powder will be deteriorated. The mixed powder for powder metallurgy according to the invention may further contain a lubricant. As examples of the lubricant, mention may be made of the same lubricants as referred to previously.

The method for producing the mixed powder for powder metallurgy according to the invention is characterized by mixing the binder of the invention to the raw powder and allowing the binder to cure. How to mix the binder with the raw powder is not specially limited, but, for example, there may be adopted a method which comprises mixing the epoxy resin with the curing agent to prepare a binder, adding the binder to the raw powder and mixing the two (in this case the epoxy resin and the curing agent are mixed together just before the addition to the raw powder), or a method which comprises adding one of the epoxy resin and the curing agent as components of the binder to the raw power, mixing the two, then adding the other to the raw powder and subsequent mixing. In the mixing, it is preferable that the raw powder and the binder be agitated using a mixing device such as mixer, high-speed mixer, Nauta mixer, V mixer, or double cone blender.

For improving the dispersibility of the binder into the raw powder, it is preferable one or both of the epoxy resin and the curing agent be heated beforehand to adjust the viscosity of the epoxy resin or the curing agent to 5,000 mPa·s or less, more preferably 1,000 mPa·s or less.

The binder/raw powder mixing temperature is not specially limited, but is in the range of 10° to 80° C. for example. By setting the mixing temperature to 10° or higher, not only it is possible to lower the viscosity of the epoxy resin which is liquid at room temperature and thereby improve the dispersibility for the raw powder, but also it is possible to cure the epoxy resin during mixing. An upper limit of the mixing temperature is not specially limited, but from the standpoint of convenience of heating equipment, it is preferable that the said upper limit be set at 80° C.

In the manufacturing method according to the invention it is also preferable that the raw powder and the binder be mixed together under heating to accelerate curing of the binder. The binder heating and curing temperature is, for example, 30° C. or higher, preferably 40° to 80° C., more preferably 60° C. or lower. It is preferable that the heating be conducted under agitating of both raw powder and binder.

EXAMPLES

The invention will be described below concretely by way of Examples, but the invention is not limited by the following Examples, and changes and modifications not departing from the gist of the invention are all included in the scope of the invention.

Example 1

[How to Evaluate a Mixed Powder for Powder Metallurgy]

(1) Percent Graphite Scattering (%)

As shown in FIG. 1, a sample powder P (25 g) is placed in a funnel-like glass tube 2 (inside diameter: 16 mm, height; 106 mm) equipped with a nuclepore filter 1 (12 μm mesh), then $N_2$ gas is allowed to flow from below for 20 minutes at a rate of 0.8 l/min, and a percent graphite scattering (%) is determined in accordance with the following equation:

Percent graphite scattering (%)=[1−(amount of graphite (g) in the sample powder after flowing of $N_2$ gas/amount of graphite (g) in the sample powder before flowing of $N_2$ gas]×100

The amount of graphite contained in the sample powder is determined by quantitative analysis of carbon contained in the sample powder.

(2) Fluidity (sec/50 g)

In accordance with JIS Z 2502 (a metal powder fluidity testing method), the time required for 50 g of a mixed powder to flow out from a 2.63 mm dia. orifice is determined as fluidity (sec/50 g).

(3) Critical Outflow Diameter 2 kg of a mixed powder is placed in a cylindrical vessel having an inside diameter of 114 mm and a height of 150 mm and having a discharge hole formed in the bottom of the vessel, the discharge hole being changeable in its diameter. After holding for 10 minutes, a minimum diameter which permits discharge of the mixed powder is determined to be a critical outflow diameter. The smaller the critical outflow diameter, the higher the fluidity.

(4) Density of Powder Compact (g/cm$^3$)

A molded product having a diameter of 11.3 mm and a height of 10 mm is produced at a pressure of 5 t/cm$^2$ (490.3 MPa) and molding temperatures of 25° C. (cold molding) and 130° C. (warm molding) and is measured for density in accordance with JSPM Standard 1-64 (a metal powder compressibility testing method).

(5) Draw-Out Pressure (MPa)

At the time of measuring the density of powder compact, a force required for drawing out the molded product from the mold used is divided by the area of contact between the mold and the powder compact and the value (MPa) obtained thereby is shown as the draw-out pressure.

[Preparing Binders for Powder Metallurgy]

Binder 1

100 parts by weight of a bisphenol A type epoxy resin (Epikote 828, viscosity 12,000 mPa·s/25° C., a product of Japan Epoxy Resin Co.) and 50 parts by weight of a heterocyclic amine curing agent (B001: 3,9-dipropaneamine-2,4,8,10-tetraoxospiro[5,5]undecane, a product of Japan Epoxy Resin Co.) were mixed together before use to prepare binder 1.

Binder 2

100 parts by weight of a bisphenol F type epoxy resin (Epikote 807, viscosity 6,000 mPa·s/25° C., a product of Japan Epoxy Resin Co.) and 50 parts by weight of a heterocyclic amine curing agent (B001, a product of Japan Epoxy Resin Co.) were mixed together before use to prepare binder 2.

Binder 3

100 parts by weight of a bisphenol A type epoxy resin diluted with a reactive diluent (Epikote 801, viscosity 4,000 mPa·s/25° C., a product of Japan Epoxy Resin Co.) and 50 parts by weight of a heterocyclic curing agent (B001, a product of Japan Epoxy Resin Co.) were mixed together before use to prepare binder 3.

Binder 4

30 parts by weight of styrene and 1 part by weight of dimethylaniline were mixed with 100 parts by weight of an unsaturated polyester resin consisting of maleic anhydride, phthalic anhydride and ethylene glycol, and 2 parts by weight of benzoyl peroxide was mixed with the resulting mixture just before use to prepare binder 4.

Binder 5

Styrene-butadiene rubber (PR2000C, a product of JSR Co.) was dissolved in toluene to prepare an 8 wt % toluene solution.

Binder 6

Rosin ester (Pensel KK, a product of Arakawa Chemical Co.) was dissolved in toluene to prepare an 8 wt % toluene solution.

[Preparing Mixed Powders for Powder Metallurgy]

Figure 2:
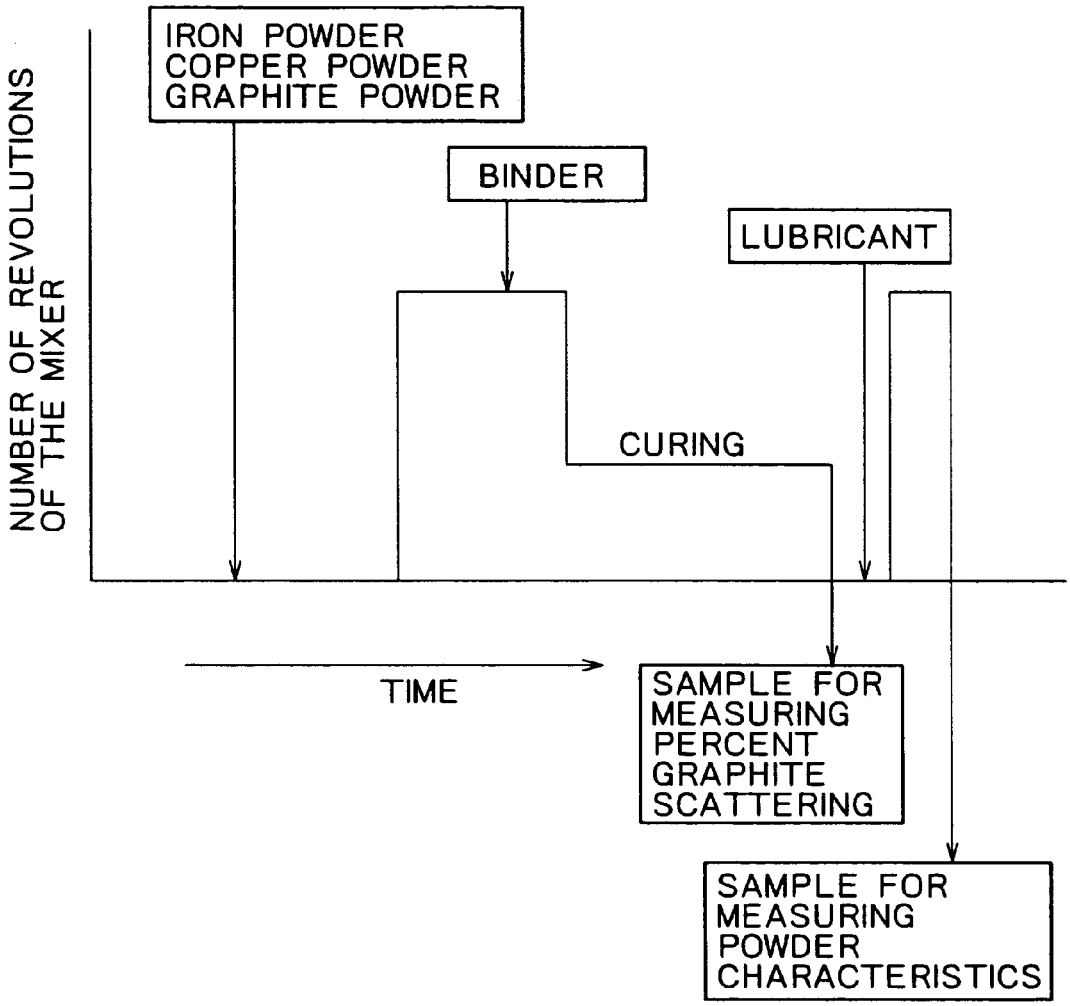
FIG. 2 is a flow chart illustrating a manufacturing method according to the invention.

While 100 parts by weight of a pure iron powder (trade name: "Atomel 300M," a product of Kobe Steel, Ltd.), 2 parts by weight of a commercially available copper powder, and 0.8 parts by weight of graphite powder were agitated at a high speed by means of a mixer with blades, the above binders 1 to 6 were added each in an amount of 0.1 part by weight (solids content), followed by strong agitation for about 5 minutes to effect mixing. Thereafter, the degree of agitation was switched to mild agitation, which agitation was carried out for 20 minutes under heating to 50° C., to afford mixed powders for powder metallurgy 1 to 6. FIG. 2 shows a pattern which represents how the number of revolutions of the mixer changes with time. As to the mixed powders 5 and 6, pressure was reduced during the 50° C. 20-minute heat-agitation to remove toluene from the mixed powders.

The mixed powders 1 to 6 thus obtained were allowed to stand all day and thereafter sampled partially to determine the percent the percent graphite scattering. Then, lubricants were added to the mixed powders 1 to 6 to prepare mixed powders for cold molding and mixed powders for warm molding, which were used as samples for measuring powder characteristics (e.g., fluidity, density of powder compact, and draw-out pressure). In the case of the mixed powders for cold molding, ethylenebisstearylamide was added in an amount of 0.8 part by weight relative to 100 parts by weight of a pure iron powder, while in the case of the mixed powders for warm molding, ethylenebisstearylamide and lithium stearate were added each in an amount of 0.3 part by weight to the pure iron powder. The results of having measured powder characteristics (in cold and warm conditions) are shown in Table 1.

TABLE 1

| | Mixed Powder | | | | | |
|---|---|---|---|---|---|---|
| | 1 | 2 | 3 | 4 | 5 | 6 |
| Type of Binder | Binder 1 Epoxy Resin Curing Agent | Binder 2 Epoxy Resin Curing Agent | Binder 3 Epoxy Resin Curing Agent | Binder 4 Unsaturated Polyester | Binder 5 Styrene-Butadiene Rubber | Binder 6 Rosin Ester |
| Percent Graphite Scattering (%) | 8 | 6 | 8 | 6 | 1 | 0 |
| Fluidity (sec/50 g) | — | — | — | — | — | — |
| 25° C. | 25.3 | 25.3 | 26.9 | 25.1 | 24.3 | 23.9 |
| 130° C. | 25.1 | 25.1 | 25.9 | 24.7 | 31.8 | 30.9 |
| Draw-out Pressure (MPa) | — | — | | — | — | — |
| 25° C. | 7.8 | 7.9 | 8.1 | 7.9 | 8.5 | 7.9 |
| 130° C. | 7.9 | 9.2 | 9.4 | 9.9 | 19.5 | 18.9 |
| Density of Powder Compact | — | — | — | — | — | — |
| 25° C. | 7.20 | 7.20 | 7.21 | 7.20 | 7.19 | 7.21 |
| 130° C. | 7.35 | 7.37 | 7.38 | 7.38 | 7.36 | 7.34 |
| Critical Outflow Dia. (mm) | 12.5 | 10 | 15 | 20 | 25 | 22.5 |
| Safety-Workability | Good | Good | Good | Offensive smell | Flammable | Flammable |
| Remarks | Example | Example | Example | Reference Example | Reference Example | Reference Example |

The mixed powders 1 and 2 were prepared using the binders 1 and 2 containing a room temperature liquid epoxy resin and an amino-containing curing agent, the mixed powder 3 was prepared using the binder 3 containing a room temperature liquid epoxy resin diluted with a reactive diluent and an amino-containing curing agent, and the mixed powders 4 to 6 were prepared using the binders 4 to 6 containing unsaturated polyester, styrene-butadiene rubber, and rosin ester, respectively.

The binder 4, because of using styrene, was bad-smelling and flammable and thus involved a problem in point of safety and workability. The binders 5 and 6, because of using toluene, were highly flammable and thus involved a problem in point of safety. On the other hand, the binders 1 to 3 according to the invention caused no problem in safety and workability because of using a room temperature liquid epoxy resin low in flammability and free of offensive smell. Particularly, the binders 1 and 2 did not correspond to the dangerous object defined by the Fire Service Law.

It is seen that the mixed powders 1 to 3 according to the invention are superior in powder characteristics (fluidity, draw-out pressure, density of powder compact, critical outflow diameter) in comparison with the mixed powders 4 to 6. Particularly, the fluidity and draw-out pressure of the mixed powders 1 and 2 at 130° C. are superior to those of the mixed powders 5 and 6 and thus the mixed powders 1 and 2 prove to be superior in warm characteristics. Further, the mixed powders 1 to 3 range in critical outflow diameter from 10 to 15 mm, which are much smaller than the critical outflow diameters 20 to 25 mm of the mixed powders 4 to 6. It follows that the mixed powders 1 to 3 are superior in fluidity to the mixed powders 4 to 6

The mixed powders 1 to 3 range in percent graphite scattering from 6% to 8%, which are a little higher than those of the mixed powders 4 to 6. However, a smaller value than 10% in percent graphite scattering poses no special problem.

Example 2

The following are examples of using different substances as curing agents.

As to the method for evaluating mixed powders for powder metallurgy, it is the same as in Example 1.

[Preparing Binders for Powder Metallurgy]

Binder 7

100 parts by weight of a bisphenol A type epoxy resin (Epikote 828, viscosity 12,000 mPa·s/25° C., a product of Japan Epoxy Resin Co.) and 60 parts by weight of polymercaptan (EH-317, a product of Asahi Denka Kogyo Co.) were mixed together before use to prepare binder 7.

Binder 8

100 parts by weight of a bisphenol A type epoxy resin (Epikote 828, viscosity 12,000 mPa·s/25° C., a product of Japan Epoxy Resin Co.) and 85 parts by weight of methyltetrahydrophthalic anhydride (EH-3326, a product of Asahi Denka Kogyo Co.) were mixed together before use to prepare binder 8.

Binder 9

100 parts by weight of a bisphenol A type epoxy resin (Epikote 828, viscosity 12,000 mPa·s/25° C., a product of Japan Epoxy Resin Co.) and 11 parts by weight of diethyltriamine were mixed together before use to prepare binder 9.

Regarding how to prepare mixed powders for powder metallurgy, it is the same as in Example 1, provided as to the binder 8, the heating temperature was set at 150° C. Further, as to the binder 8, it took time for cooling to a lubricant-adding temperature (about 50° C. or lower).

Measuring samples were prepared from the resulting mixed powders 7 to 9 in the same way as in Example 1 and were measured for various characteristics. The results obtained are shown in Table 2.

TABLE 2

| | Mixed Powder | | |
|---|---|---|---|
| | 7 | 8 | 9 |
| Type of Binder | Binder 7 Epoxy Resin (polymercaptan) | Binder 8 Epoxy Resin (methyltetrahydrophthalic anhydride) | Binder 9 Epoxy Resin (diethyltriamine) |
| Percent Graphite Scattering (%) | 9 | 7 | 8 |
| Fluidity (sec/50 g) | — | — | — |
| 25° C. | 24.9 | 25.8 | 25.1 |
| 130° C. | 25.0 | 25.5 | 24.9 |
| Draw-out Pressure (MPa) | — | — | — |
| 25° C. | 7.8 | 7.7 | 8.0 |
| 130° C. | 8.3 | 8.7 | 8.9 |
| Density of Powder Compact | — | — | — |
| 25° C. | 7.21 | 7.20 | 7.20 |
| 130° C. | 7.38 | 7.36 | 7.37 |
| Critical Outflow Dia. (mm) | 12.5 | 12.5 | 10 |
| Safety-Workability | Good | Iron powder high in temperature | Good |
| Remarks | Example | Example | Example |

From Table 2 it is seen that also in the use of the mixed powders 7 to 9 there are obtained powder characteristics equal to those obtained by using the mixed powders 1 to 3 in Example 1.

Comparative Examples

Next, as comparative examples, there will be shown an example of combining an epoxy resin not liquid at room temperature with a curing agent defined in the invention and an example of combining an epoxy resin liquid at room temperature with a curing agent not defined in the invention.

As to the method for evaluating mixed powders for powder metallurgy, it is the same as in Example 1.

[Preparing Binders for Powder Metallurgy]

Binder 10

100 parts by weight of a bisphenol A type epoxy resin (Epikote 1004, solid type, a product of Japan Epoxy Resin Co.) and 10 parts by weight of a heterocyclic amine curing agent (B001, a product of Japan Epoxy Resin Co.) were mixed together before use to prepare binder 10.

Binder 11

100 parts by weight of a bisphenol A type epoxy resin (Epikote 828, viscosity 12,000 mPa·s/25° C., a product of Japan Epoxy Resin Co.) and 8 parts by weight of dicyandiamide (DICY 7, a product of Japan Epoxy Resin Co.) which is a powdery curing agent were mixed together before use to prepare binder 11.

In both binders 10 and 11, it was difficult to effect intimate mixing because of liquid-solid mixing.

Regarding how to prepare mixed powders, it is basically the same as in Example 1. However, for melting respective solids, it was necessary to set heating temperatures at 140° C. and 180° C. in the use of binder 10 and beinder 11, respectively. Moreover, it took a long time for the melting. The agitation time of 20 minutes adopted in the Examples was insufficient and an agitation time of 60 minutes was required. Further, it took time for cooling to a lubricant-adding temperature (about 50° C. or lower)

Measuring samples were prepared from the resulting mixed powders in the same way as in Example 1 and were measured for various characteristics. The results obtained are shown in Table 3.

TABLE 3

| | Mixed Powder | |
|---|---|---|
| | 10 | 11 |
| Type of Binder | Binder 10 Epoxy Resin (Solid) Curing Agent | Binder 11 Epoxy Resin Powder Curing Agent |
| Percent Graphite Scattering (%) | 12 | 15 |
| Fluidity (sec/50 g) | — | — |
| 25° C. | 22.5 | 22.1 |
| 130° C. | 22.9 | 22.4 |
| Draw-out Pressure (MPa) | — | |
| 25° C. | 8.2 | 7.9 |
| 130° C. | 8.8 | 8.6 |
| Density of Powder Compact | — | — |
| 25° C. | 7.21 | 7.20 |

TABLE 3-continued

| | Mixed Powder | |
|---|---|---|
| | 10 | 11 |
| 130° C. | 7.38 | 7.37 |
| Critical Outflow Dia. (mm) | 12.5 | 10 |
| Safety-Workability | Iron powder high in temperature, poor workability | Iron powder high in temperature, poor workability |
| Remarks | Comparative Example | Comparative Example |

As to fluidity, because of a long agitation time, there were obtained fluidity values lower than but relatively close to those obtained by using the mixed powders 1 to 3 in Example 1. There is the possibility that the fluidity will be improved by further prolonging the agitation time. In this case, however, a marked lowering of productivity will result, which is a fatal disadvantage.

It is seen that the mixed powders 10 and 11 are inferior in percent graphite scattering to the mixed powders 1 to 3 used in Example 1 and the mixed powders 7 to 9 used in Example 2.

What is claimed is:

1. A mixed powder for powder metallurgy comprising a raw powder for powder metallurgy and a cured product of a binder comprising:

an epoxy resin which is liquid at room temperature and a curing agent having at least one functional group selected from the group consisting of amino, mercapto and carboxyl groups, wherein the content of said cured product of said binder is in the range of 0.01 to 0.5 part by weight based on 100 parts by weight of the raw powder.

2. The mixed powder for powder metallurgy according to claim 1, wherein the viscosity of said epoxy resin is 15,000 mPas. or lower at 25° C.

3. The mixed powder for powder metallurgy according to claim 1, wherein said epoxy resin is a bisphenol A or F type epoxy resin.

4. The mixed powder for powder metallurgy according to claim 1, wherein said curing agent is an amino group-containing curing agent.

5. A method for producing a mixed powder for powder metallurgy, which comprises adding the binder described in claim 1 to a raw powder for powder metallurgy, mixing the two, and allowing the binder to cure.

* * * * *